United States Patent [19]

Denzin et al.

[11] 4,398,458

[45] Aug. 16, 1983

[54] ADJUSTMENT DEVICE FOR POSTAGE METERING AND VALUE STAMPING MACHINES

[75] Inventors: Horst Denzin; Wolfgang Von Inten; Horst Päch, all of Berlin, Fed. Rep. of Germany

[73] Assignee: Francotyp Gesellschaft mbH, Berlin, Fed. Rep. of Germany

[21] Appl. No.: 358,700

[22] Filed: Mar. 16, 1982

[30] Foreign Application Priority Data

Mar. 23, 1981 [DE] Fed. Rep. of Germany ..... 3111949

[51] Int. Cl.[3] ..... B41J 1/20

[52] U.S. Cl. ..... 101/91; 101/110

[58] Field of Search ..... 101/76, 45, 91, 85-86, 101/109, 110; 235/58 P

[56] References Cited

U.S. PATENT DOCUMENTS

| | | | |
|---|---|---|---|
| 3,682,378 | 8/1972 | Rouan et al. | 101/91 X |
| 3,823,666 | 7/1974 | Hanson | 101/91 |
| 3,890,491 | 6/1975 | Malavazos et al. | 101/91 |
| 3,918,361 | 11/1975 | Malavazos et al. | 101/91 |
| 3,965,815 | 6/1976 | Lupkas et al. | 101/110 X |
| 3,978,457 | 8/1976 | Check, Jr. et al. | 101/91 |
| 4,050,374 | 9/1977 | Check, Jr. | 101/110 |
| 4,090,063 | 5/1978 | Martin | 101/91 X |
| 4,140,054 | 2/1979 | Martin et al. | 101/91 |
| 4,207,814 | 6/1980 | Schenk | 101/76 |
| 4,367,676 | 1/1983 | Clark | 101/91 |

FOREIGN PATENT DOCUMENTS

| | | | |
|---|---|---|---|
| 1561253 | 2/1970 | Fed. Rep. of Germany | 101/110 |
| 2079223 | 1/1982 | United Kingdom | 101/91 |

*Primary Examiner*—E. H. Eickholt

*Attorney, Agent, or Firm*—Herbert L. Lerner; Laurence A. Greenberg

[57] ABSTRACT

Adjusting device for postage metering and value stamping machines for adjusting printing rollers and cylinders which includes type wheels mounted in a printing cylinder having a shaft, each of the type wheels having a respective stepping motor operatively associated therewith for adjusting the respective type wheel by means of a respective toothed rack and a respective double toothed rack, the toothed racks and the stepping motors being disposed radially to the printing-cylinder shaft and the double toothed racks being disposed parallel to one another, a selective printing roller adjustable by one of the double toothed racks via a belt drive, the toothed racks and the double toothed racks being coupled by a hook-connection, one of the respective toothed and double toothed racks having a widened hook-shaped part, the double toothed racks being adjustable beyond a maximally required number of steps of the type wheels, and the ends of the double toothed racks being guidable laterally out of the printing cylinder for actuating respective levers to adjust, in stepwise manner, further printing rollers.

10 Claims, 5 Drawing Figures

ADJUSTMENT DEVICE FOR POSTAGE METERING AND VALUE STAMPING MACHINES

The invention relates to an adjustment device for postage metering or franking and value stamping machines for adjusting printing rollers and the like thereof.

It has become known heretofore to adjust or shift print wheels or type wheels of postage metering machines, for example, by means of toothed racks. The print wheels or type wheels are located in a printing cylinder or drum disposed on the end of a shaft. The shaft has a cross section of such shape that the racks extend parallel to one another in a formed-out part thereof such as, for example, a slot. Control or shifting drums with spokes, which are displaced by means of manually operative adjustment members, serve for shifting the racks.

This type of adjustment requires great mechanical outlay or expense which is coupled, moreover, with great expense for production and adjustment technology.

Other heretofore known adjustment devices of the foregoing general type employ electrically controlled stepping motors for adjusting the racks. The mechanical expense is thereby reduced. However, because of the parallel guidance in the formed-out part of the shaft, only a limited number of racks can be provided if the diameter of the shaft is not to be increased. For this reason, the existing racks are reserved exclusively for adjusting the value print rollers i.e. the rollers printing the amount of postage, for example.

It is an object of the invention to provide an adjustment device for postage metering and value stamping machines which, by means of electrically controlled stepping motors, also affords adjustment of the date and further print rollers, such as a selective print roller, for example, besides the value or amount printing adjustment.

With the foregoing and other objects in view, there is provided, in accordance with the invention, an adjusting device for postage metering and value stamping machines for adjusting printing rollers and cylinders including type wheels mounted in a printing cylinder having a shaft, each of the type wheels having a respective stepping motor operatively associated therewith for adjusting the respective type wheel by means of a respective toothed rack and respective double toothed rack, the toothed racks and the stepping motors being disposed radially to the printing-cylinder shaft and the double toothed racks being disposed parallel to one another, a selective printing roller adjustable by one of the double toothed racks via a belt drive, the toothed racks and the double toothed racks being coupled by a hook-connection, one of the respective toothed and double toothed racks having a widened hook-shaped part, the double toothed racks being adjustable beyond a maximally required number of steps of the type wheels, and the ends of the double toothed racks being guidable laterally out of the printing cylinder for actuating respective levers to adjust, in stepwise manner, further printing rollers.

In accordance with another feature of the invention, a plurality of magnets are carried by each of the toothed racks.

In accordance of a further feature of the invention, stationary probes for adjusting control are disposed opposite the magnets.

In accordance with an additional feature of the invention, each of the double toothed racks have two opposing rows of teeth, one of the rows of teeth serving for adjustment of individual type wheel and selective printing rollers, and the other of the rows of teeth for alignment, in common, of all of the type wheels and the selective printing roller for the printing process.

In accordance with an added feature of the invention, a locking rod is mounted in a slider, the locking rod continuously resiliently engaging the double toothed rack.

In accordance with yet another feature of the invention, the locking rod is guided, secured against torsion, in a slot formed in the printing-cylinder shaft.

In accordance with yet a further feature of the invention, a lever is mounted in the printing-cylinder shaft and coupled with the slider, and a stationary magnet, the last-mentioned lever being actuatable by the magnet through the intermediary of a plunger for releasing the double toothed racks during adjustment of the type wheels.

In accordance with yet an additional feature of the invention, the lever carries a magnet at an end thereof, and includes a stationary probe whereon the magnet carried by the lever acts for controlling a normal setting of the printing-cylinder shaft and a setting of the locking rod.

In accordance with yet an added feature of the invention, the stepping motors have pinions and intermediate gears operatively associated therewith, and the printing-cylinder shaft is formed with annular offsets serving as radial tooth locks for the pinions and the intermediate gears during a printing operation.

In accordance with an alternate feature of the invention, the levers are actuatable by the double toothed racks of U-shaped construction and are mounted on the printing cylinder for pivoting about the lateral legs of the U-shaped racks.

Other features which are considered as characteristic for the invention are set forth in the appended claims.

Although the invention is illustrated and described herein as embodied in adjustment device for postage metering and value stamping machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof wil be best understood from the following description of specific embodiments when read in connection with the accompanying drawings, in which.

In all of the figures, like parts are identified by the same reference numerals. The following description is based upon a postage metering machine as an example. The invention is applicable, however, also to other value printing and stamping machines.

Figure 1:
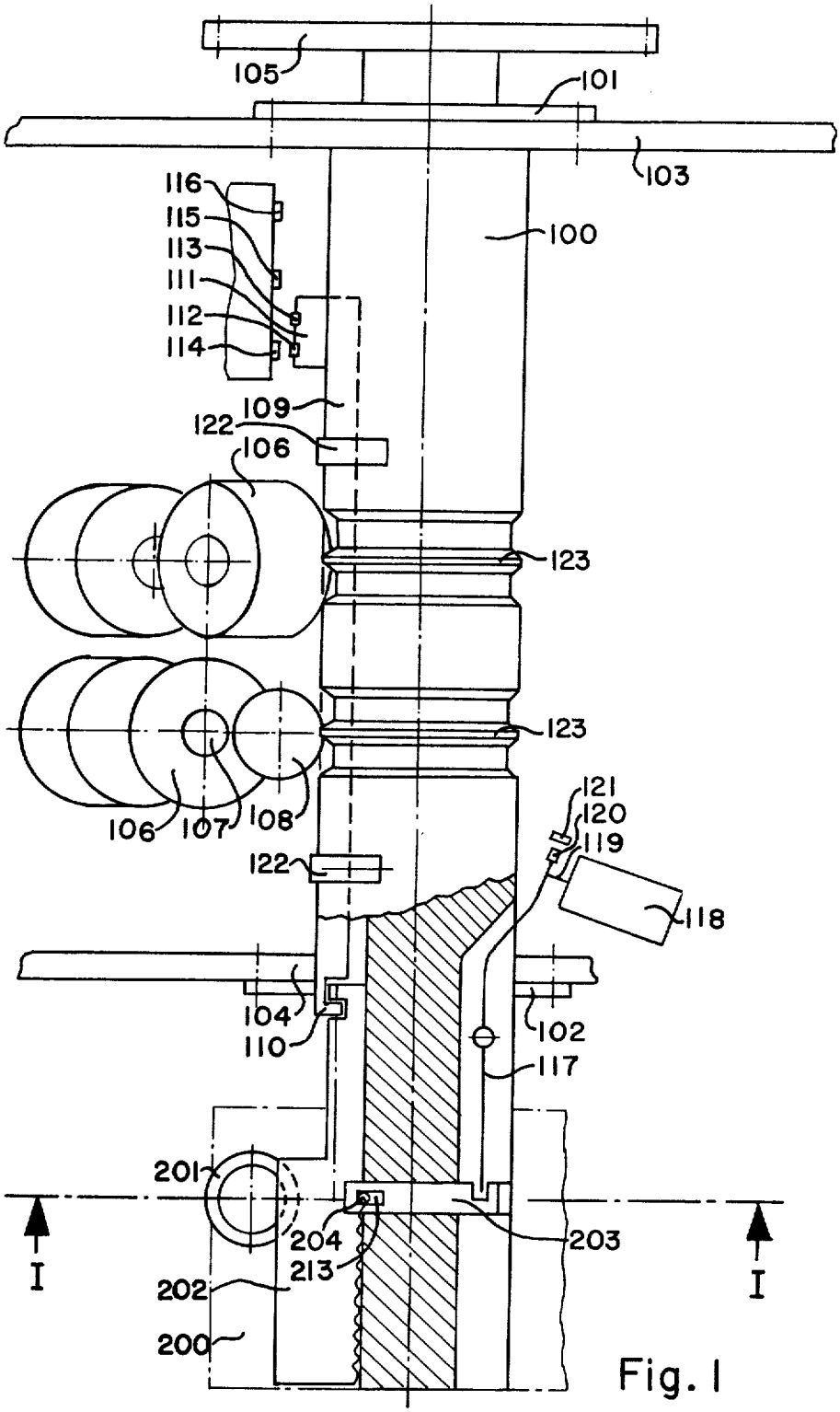
FIG. 1 is a diagrammatic axial view, partly broken away and partly in section of a printing cylinder shaft of a postage metering machine, for example, and the adjustment device according to the invention.

Referring now to the drawings and, more particularly, to FIG. 1 thereof, there is shown a printing-cylinder shaft 100 mounted by means of two ball bearings 101, 102 in plates 103, 104, respectively, of a postage metering or franking machine. One of the ends of the printing-cylinder shaft 100 carries a drive gear 105, and a printing cylinder 200 is set on the other of the ends. Type wheels 201 are disposed parallel to one another in the printing cylinder 200 and, as apparent in FIG. 2, six type wheels 201, for example, are provided for the value or amount printing.

For each type wheel 201, an adjustment device is provided which is formed of several components: a stepping motor 106 with a pinion 107 and, depending upon the location of the motor with respect to the printing-cylinder shaft 100 one or more intermediate gears 108, a toothed rack 109 and a double toothed rack 202. The six toothed racks 109 required in the illustrated embodiment of FIG. 3 for six type wheels 201 are disposed radially to the printing-cylinder shaft 100.

The radial disposition of the toothed racks 109 provides the advantage of space-saving accommodation of the stepping motors 106. As shown diagrammatically in FIG. 3, the stepping motors 16 are also disposed radially to the printing-cylinder shaft 100. In addition, due to the radial positioning, like contact or engagement conditions are provided at any desired location of the toothed racks 109, so that like toothed racks 109 are able to be used for controlling any number of type printing or other printing devices.

Figure 3:
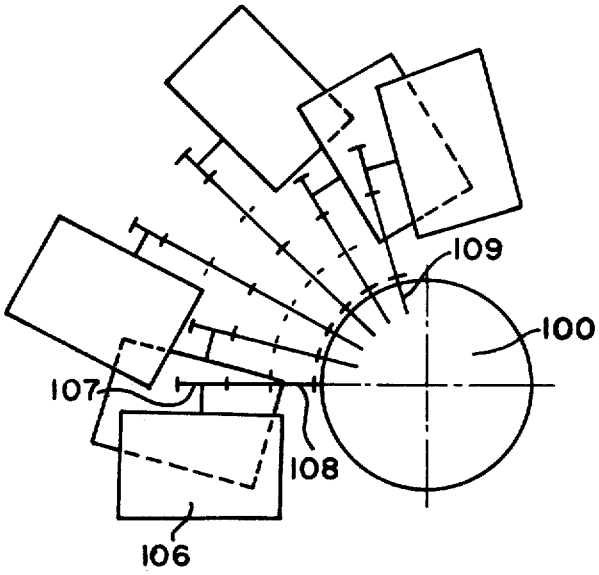
FIG. 3 is a diagrammatic reduced end view of the printing cylinder shaft showing the disposition of stepping motors relative thereto.

The toothed racks 109 are guided in holders set on the printing-cylinder shaft 100 or, preferably, in slots formed in the shaft 100, as shown in FIGS. 1 and 3. To prevent canting or tilting, the toothed racks 109 are secured by bands 122. Each toothed rack 109 is hook-shaped at the end thereof facing towards the double toothed rack 202.

The double toothed rack 202 is likewise hook-shaped at the end thereof facing towards the toothed rack 109. Each toothed rack 109 is enlarged or widened at the hook-shaped part 110 thereof, or the hook-shaped part of the double toothed rack 202 is enlarged. The enlargement or widening of the hook-shaped part 110 of a toothed rack 109, for example, permits the coupling of the radially disposed toothed rack 109 with the double toothed rack 202 disposed parallel thereto without requiring any further constructive measures or additional adjustment expense.

Each toothed rack 109 is formed at the other end thereof, for example, with a perpendicularly extending leg 111. This leg 111 projects over the teeth of the toothed rack 109 disposed between the leg 111 and the hook-shaped part 110 and carries a number of magnets 112, 113. These magnets 112, 113 are disposed opposite stationary probes 114, 115, 116 which serve for adjustment control. This adjustment control is effected by means of suitable signals which are generated when shifting the toothed rack 109 and the thereby varying action of the magnets 112, 113 upon the probes 114, 115, 116. Although two magnets 112, 113 and three probes 114, 115, 116 are shown in the embodiment of FIG. 1, the number thereof may be varied as desired.

To adjust the type wheels 201 or other printing devices, the respective toothed rack 109 is shifted or displaced by means of the respective stepping motor 106 via the pinion 107 and, if necessary or desirable, via further intermediate gears 108. The double toothed tack 202 associated therewith is also moved. The double toothed rack 202 has two opposing rows of teeth, one of the rows serving for adjusting the associated type wheel 201, and the other tooth row for aligning or orienting all of the type wheels for the printing operation.

For the purpose of aligning or orienting all of the type wheels, a slider 203 is provided which carries a notched rod 204. The notched rod 204 and the slider 203 are resiliently mounted in the printing-cylinder shaft 100. The notched rod 204 is guided in a slot 213 and secured against torsion. It engages or locks in a respective tooth gap of the double teeth rack 202 of all of the type wheels 201. The double toothed racks 202 are, accordingly, pressed against the teeth of the type wheels 201 and fix the latter in the respective position thereof.

The fixed setting of the type wheels 201 is terminated or cancelled only with an adjustment operation. For this purpose, there is provided a lever 117 which is pivotally or swingably mounted in a formed-out part of the printing-cylinder shaft 100 and which is connected to the slider 203.

Because the lever 117, on the one hand, rotates with the printing-cylinder shaft 100 and, on the other hand, is moved by a tappet or plunger 119, it is additionally provided for controlling the normal setting of the postage metering machine as well as the setting of the notched or locking rod 204. For this purpose, the free end of the lever 117 carries a magnet 120. A stationary probe 121 is associated with the magnet 120 and, only if both elements 120 and 121 i.e. magnet and probe, are disposed opposite one another, is the normal setting of the printing-cylinder shaft 100 provided for simultaneous locking position of all of the type wheels 201.

In order to prevent shifting of the stepping motors 106 during a revolution of the printing-cylinder shaft 100, the latter is annularly reduced in diameter in vicinity of the toothed racks 109. The annular offsets or stops 123 thus formed are removed in the entire region of the toothed racks 109, for reasons of manufacturing technology. During a rotation or revolution of the printing-cylinder shaft 100, the offsets or stops 123 act like a radial toothed locking device on the pinion 107 and the intermediate gears 108, respectively. Furthermore, the pinion 107 and the intermediate gears 108 are so wide in construction that, during a rotation of the printing-cylinder shaft 100, they already mesh with the toothing of the next-disposed toothed rack 109 before they leave the toothed region of the toothed rack 109 with which they were yet meshed. Thereby, a radial toothed lock is always assured.

Figure 2:
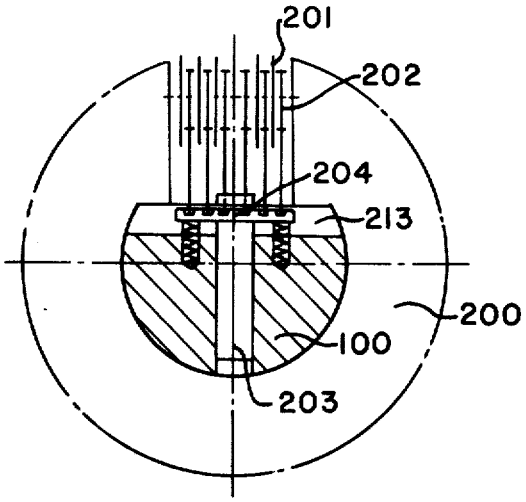
FIG. 2 is a cross-sectional view of FIG. 1 taken along the line I—I in direction of the arrows, and showing type wheels and the adjustment device according to the invention only diagrammatically.

In the illustrated embodiment of FIGS. 1 to 3, the type rollers 201 for the value or amount printing of a postage metering machine is exclusively shown. In a corresponding manner, a further toothed rack at the periphery of the printing-cylinder shaft 100 is controllable by means of a further stepping motor, and a selective printing roller in the printing cylinder 200 is controllable by means of a further toothed or double toothed rack. Preferably, a further gear 211 is moved with the toothing associated with the hook-shaped part 110 of the double toothed rack 202, the gear 211 being associated with a belt drive 212 which adjusts a selective printing roller 210.

Figure 4:
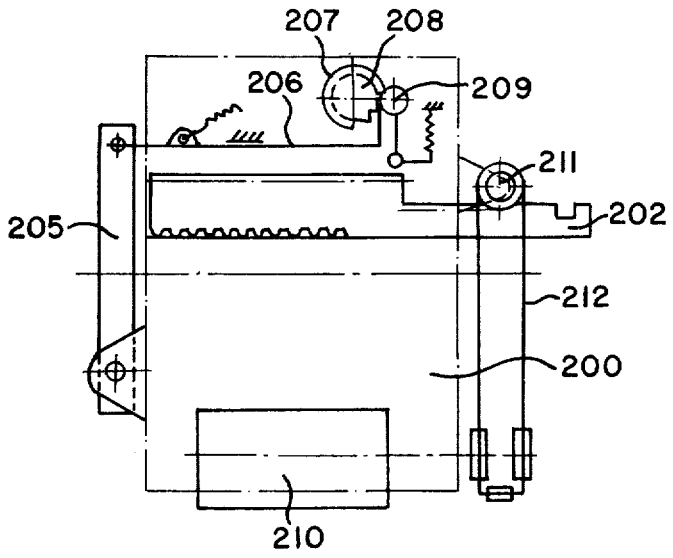
FIG. 4 is a diagrammatic view of an additional lever support system on the printing cylinder for controlling further printing rollers and the drive of a selective printing roller.
Figure 5:
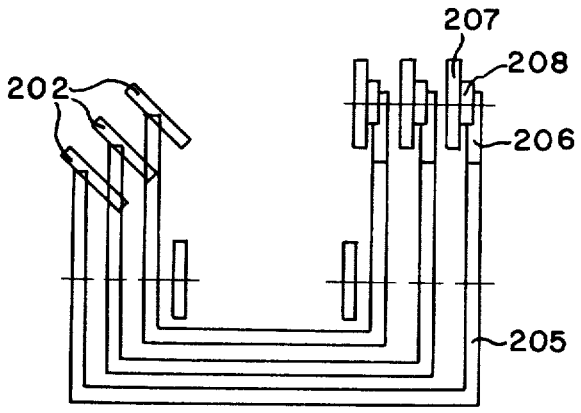
FIG. 5 is a diagrammatic view of adjustment levers suitably disposed for additional printing rollers.

An advantageous additional use of the type=wheel adjustment is shown in FIGS. 4 and 5. Nine adjustment steps of the stepping motors and a corresponding number of shifting steps of the toothed racks 109 are required for the type wheels 201 preferably carrying ten digits. If, in contrast therewith, the adjustment or setting number of the stepping motors and toothed racks is widened or extended, for example, by one step, then further printing rollers are adjustable. For this purpose, the double toothed racks 202 must be made at least so long that they reach the lateral edge of the printing cylinder 200 or project therefrom a slight amount if, for example, the highest digit of the type wheels is set. With a further i.e. tenth step of a stepping motor 106, in the aforementioned embodiment, the corresponding double toothed rod 202 is slid laterally out of the printing cylinder 200 and actuates a lever 205. This lever 205 which is of U-shaped construction, for example, is mounted on the printing cylinder 200 so as to be pivotable or swingable about a lateral leg, and is connected to a pawl 206. The pawl 206 acts upon a detent or ratchet wheel 208 coupled with a further print wheel 207 and adjusts the latter by one step, respectively. By means of a detent or ratchet lever 209, the printing roller 207 is fixed so that the latter is not adjustable without actuation of the lever 205.

This additional stepwise adjustment of further printing rollers is preferably established for adjusting or setting the date printing device in postage metering machines. To release the stepping motors for the aforementioned additional adjustment operation, the type wheels are to be decoupled, for example, by means of tooth lockouts on the double toothed racks, the fixing or arresting of the type wheels being assured by nonillustrated measures.

We claim:

1. Adjusting device for postage metering and value stamping machines for adjusting printing rollers and cylinders comprising type wheels mounted in a printing cylinder having a shaft, each of said type wheels having a respective stepping motor operatively associated therewith for adjusting the respective type wheel by means of a respective toothed rack and a respective double toothed rack, said toothed racks and said stepping motors being disposed radially to said printing-cylinder shaft and said double toothed racks being disposed parallel to one another, a selective printing roller adjustable by one of said double toothed racks via a belt drive, said toothed racks and said double toothed racks being coupled by a hook-connection, one of the respective toothed and double toothed racks having a widened hook-shaped part, said double toothed racks being adjustable beyond a maximally required number of steps of said type wheels, and the ends of said double toothed racks being guidable laterally out of said printing cylinder for actuating respective levers to adjust, in a stepwise manner, further printing rollers.

2. Adjusting device according to claim 1 including a plurality of magnets carried by each of said toothed racks.

3. Adjusting device according to claim 2 including stationary probes for adjusting control disposed opposite said magnets.

4. Adjusting device according to claim 1 wherein each of said double toothed racks have two opposing rows of teeth, one of said rows of teeth serving for adjustment of individual type wheel and selective printing rollers, and the other of said rows of teeth for alignment, in common, of all of said type wheels and said selective printing roller for the printing process.

5. Adjusting device according to claim 1 including a locking rod mounted in a slider, said locking rod continuously resiliently engaging said double toothed rack.

6. Adjusting device according to claim 5 wherein said locking rod is guided, secured against torsion, in a slot formed in said printing-cylinder shaft.

7. Adjusting device according to claim 5, including a lever mounted in said printing-cylinder shaft and coupled with said slider, and a stationary magnet, said last-mentioned lever being actuatable by said magnet through the intermediary of a plunger for releasing said double toothed racks during adjustment of the type wheels.

8. Adjusting device according to claim 7 wherein said lever carries a magnet at an end thereof, and including a stationary probe whereon said magnet carried by said lever acts for controlling a normal setting of said printing-cylinder shaft and a setting of said locking rod.

9. Adjusting device according to claim 1 wherein said stepping motors have pinions and intermediate gear operatively associated therewith, and said printing-cylinder shaft is formed with annular offsets serving as radial tooth locks for said pinions and said intermediate gears during a printing operation.

10. Adjusting device according to claim 1 wherein said levers actuatable by said double toothed racks are of U-shaped construction and are mounted on the printing cylinder for pivoting about the lateral legs of said U-shaped racks.

* * * * *